United States Patent [19]

Mines, Jr. et al.

[11] Patent Number: 4,638,923

[45] Date of Patent: Jan. 27, 1987

[54] GRAVITY FEEDING PILL MEDICINE DISPENSER

[76] Inventors: Isaiah H. Mines, Jr.; George Spector, both of 233 Broadway RM 3615, New York, N.Y. 10007

[21] Appl. No.: 721,222

[22] Filed: Apr. 8, 1985

[51] Int. Cl.[4] ..... G07F 11/00

[52] U.S. Cl. ..... 221/132; 221/197; 221/266; 221/281; 222/325

[58] Field of Search ..... 222/144, 366, 368, 181, 222/325; 221/132, 266, 197, 281

[56] References Cited

U.S. PATENT DOCUMENTS

| | | | |
|---|---|---|---|
| 888,464 | 5/1908 | Burri et al. | 222/144 |
| 2,091,518 | 8/1937 | Murphy | 222/181 |
| 3,276,636 | 10/1966 | Johnson | 221/266 |
| 4,515,293 | 5/1985 | Hill et al. | 222/181 |

FOREIGN PATENT DOCUMENTS

| | | | |
|---|---|---|---|
| 103626 | 2/1924 | Switzerland | 222/181 |

*Primary Examiner*—H. Grant Skaggs

[57] ABSTRACT

A gravity feeding pill dispenser is provided and consists of a device for dispensing pills from each aperture of a plurality of apertures on a caddy disc that is rotatably mounted to a shaft on a weighted base plate.

1 Claim, 5 Drawing Figures

GRAVITY FEEDING PILL MEDICINE DISPENSER

BACKGROUND OF THE INVENTION

The instant invention relates generally to devices for dispensing pills and more specifically it relates to a gravity feeding pill dispenser.

Numerous devices have been provided in prior art that are adapted to dispense pills. For example, U.S. Pat. Nos. 3,991,908; 4,150,766 and 4,228,920 all are illustrative of such prior art. While these units may be suitable for the particular purpose to which they address, they would not be as suitable for the purpose of the present invention as heretofore described.

SUMMARY OF THE INVENTION

A principle object of the present invention is to provide a gravity feeding pill dispenser that can dispense various types of pills therefrom.

Another object is to provide a gravity feeding pill dispenser that can hold various size pill bottles so that different amounts of pills can be dispensed therefrom.

An additional object is to provide a gravity feeding pill dispenser that is designed to accommodate push-in type bottles having resilient skirts thereon.

A further object is to provide a gravity feeding pill dispenser that is economical in cost to manufacture.

A still further object is to provide a gravity feeding pill dispenser that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
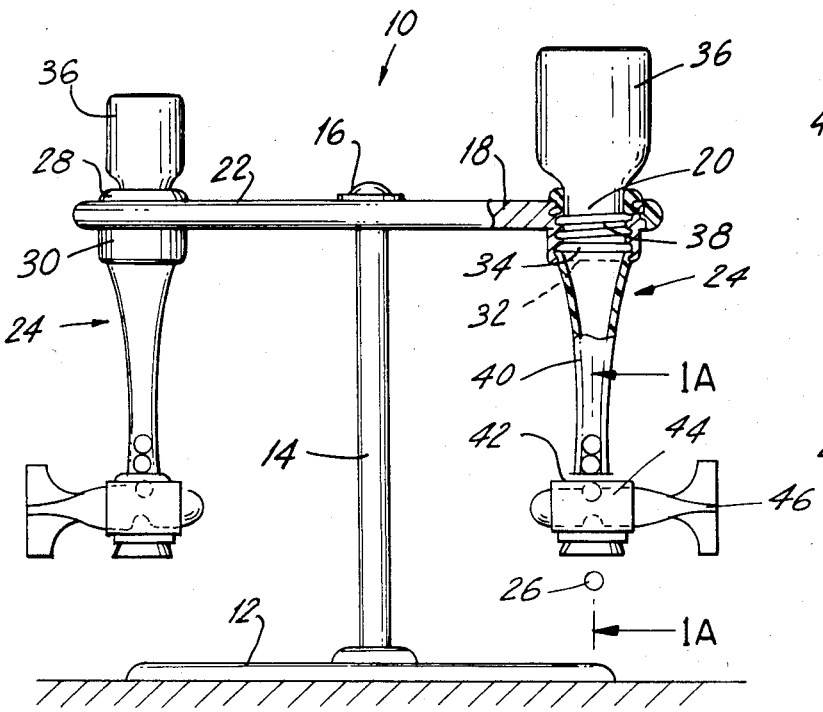
FIG. 1 is a side view of the invention with parts broken away.
Figure 1A:
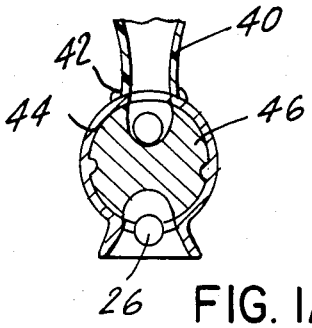
FIG. 1A is an enlarged cross sectional view taken along line 1A—1A of FIG. 1 showing alignment of the pill dispenser with feeder tube.
Figure 2:
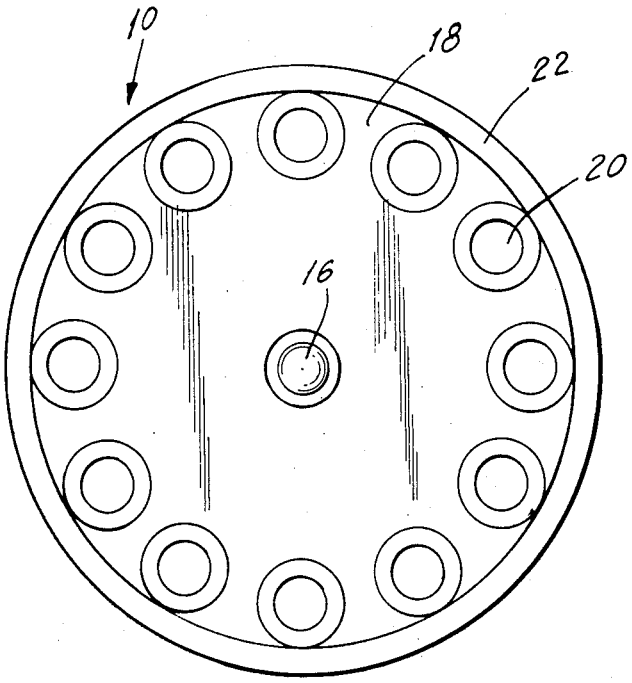
FIG. 2 is a top view of the caddy disc.

Turning now descriptively to the drawings, in which similar reference characters denote similar elements throughout the several views, FIGS. 1, 1A and 2 illustrates a gravity feeding pill dispenser 10 that contains a base plate 12 being weighted for stability. A vertical shaft 14 is mounted to center of the base plate 12 and a ball bearing rotator 16 is mounted to top of the vertical shaft 14. A caddy disc 18 that has a plurality of apertures 20 around its perimeter 22 is rotatably mounted at center to the ball bearing rotator 16.

A device 24 is provided for dispensing pills 26 from each aperture 20 of the caddy disc 18. The device 24 contains a first gasket 28 for fitting within the aperture 20 in the caddy disc 18. An inverted threaded bottle top 30 is formed on underside of the caddy disc below the aperture 20 with the bottle top 30 having an opening 32 therethrough.

A second gasket 34 fits within the opening 32 of the bottle top so that a pill bottle 36 that has a threaded neck 38 will engage with the bottle top 30. A clear feeder tube 40 extends downwardly from the opening 32 of the bottle top 30. A third gasket 42 fits on bottom end of the feeder tube 40. A sealed cylinder 44 that has a turn key stop cock 46 is affixed to the bottom end of the feeder tube whereby one turn of the turn key stop cock 46 dispenses one pill 26 therefrom.

As shown in FIG. 1 each pill bottle 36 can come in various sizes so that various amounts of pills 26 can be dispensed therefrom.

Figure 4:
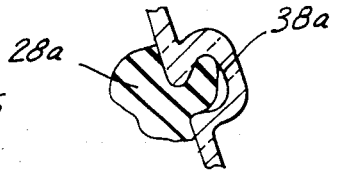
FIG. 4 is an enlarged cross sectional view as indicated by numeral 4 in FIG. 3 showing details of the bead on the bottle and gasket in engagement thereof.
Figure 3:
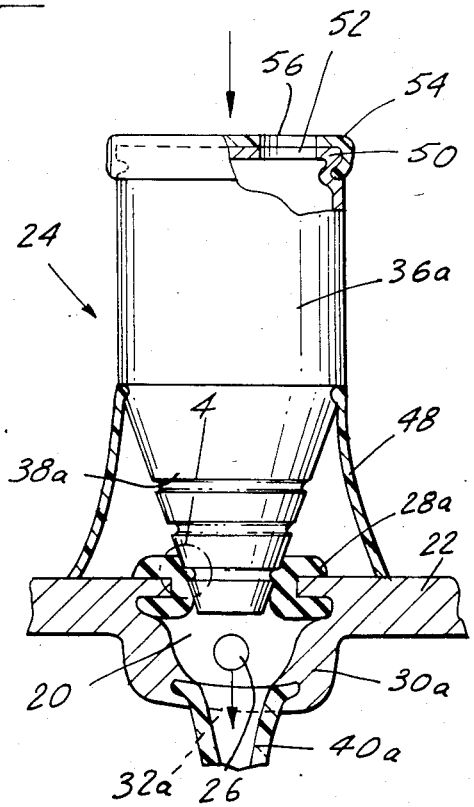
FIG. 3 is an enlarged cross sectional view of a modification showing a push-in type bottle with resilient skirt.

FIGS. 3 and 4 show another type of dispensing device **24*a* that contains a first resilient gasket 28*a* for fitting within the aperture 20 in the caddy disc 22. An inverted bottle top 30*a* is formed on underside of the caddy disc 22 below the aperture 20 with the bottle top 30*a* having an opening 32*a* therethrough. A push-in pill bottle 36*a* is provided and has a beaded neck 38*a* for engagement with the first resilient gasket 28*a*. A clear feeder tube 40*a* extends downwardly from the opening 32*a* of the bottle top 30*a*. The rest of the device 24*a* has the same structure as the device 24 for dispensing pills 26**.

The pill bottle **36*a* further contains a resilient skirt 48 extending downwardly from the neck 38*a* for engagement to top side of the caddy disc 22** to stabilize the pill bottle and ensure freshness.

The base 50 of the pill bottle **36*a* has an aperture 52 therethrough. A cap 54 that has an aperture 56 is rotatably affixed to the base 50 of the pill bottle 36*a*. When the aperture 56 of the cap 54 lines up with the aperture 52 of the base 50, pills 26 can be refilled within the pill bottle without removing the pill bottle from the caddy disc 22**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A gravity feeding pill dispenser which comprises:

(a) a base plate being weighted for stability;

(b) a vertical shaft mounted to center of said base plate;

(c) a ball bearing rotator mounted to top of said vertical shaft;

(d) a caddy disc having a plurality of apertures around perimeter, said caddy disc rotatably mounted at center to said ball bearing rotator;

(e) means for dispensing pills from each said aperture of said caddy disc, wherein each said dispensing means comprises:

(f) a first resilient gasket for fitting within an aperture in said caddy disc;

(g) an inverted bottle top formed on underside of said caddy disc below said aperture, said bottle top having an opening therethrough;

(h) a push-in pill bottle having a beaded neck for engagement with said first resilient gasket;

(i) a clear feeder tube extending downwardly from said opening of said bottle top;

(j) a second gasket for fitting on bottom end of said feed tube;

(k) a sealed cylinder having a turn key stop cock, said sealed cylinder affixed to said bottom end of said feeder tube whereby one turn key stop cock dispenses one pill therefrom, wherein said push-in pill bottle further comprises:

(l) a resilient skirt extending downwardly from said neck for engagement to top side of said caddy disc to stabilize said pill bottle and ensure freshness;

(m) a base of said pill bottle having an aperture therethrough; and (n) a cap having an aperture, said cap rotatably affixed to said base of said pill bottle so that when said aperture of said cap lines up with said aperture of said base, pills can be refilled within said pill bottle without removing said pill bottle from said caddy disc.

* * * * *